US005988296A

United States Patent [19]

Zachman et al.

[11] Patent Number: 5,988,296

[45] Date of Patent: Nov. 23, 1999

[54] FLAG INSERTION TOOL

[76] Inventors: Stan Zachman, 10901 SW. Fox Brown Rd., Indiantown; Sean J. Cribb, 2004 SW. 35th Ave., Delray Beach, both of Fla. 33445

[21] Appl. No.: 09/116,674

[22] Filed: Jul. 16, 1998

[51] Int. Cl.[6] ..... B25D 1/16

[52] U.S. Cl. ..... 173/1; 173/90; 227/147

[58] Field of Search ..... 173/90, 91, 1; 227/147

[56] References Cited

U.S. PATENT DOCUMENTS

| | | | |
|---|---|---|---|
| 337,061 | 3/1886 | Higgins et al. | 227/147 |
| 350,420 | 10/1886 | Dillon | 227/147 |
| 746,549 | 12/1903 | Modlin et al. | 227/147 |
| 1,646,039 | 10/1927 | Murton . | |
| 2,300,813 | 11/1942 | Savage | 173/90 |
| 2,475,041 | 7/1949 | Mattson | 145/24 |
| 2,934,984 | 5/1960 | Woodman | 173/91 |
| 3,060,257 | 10/1962 | Spurgeon | 174/7 |
| 3,381,763 | 5/1968 | Matson | 173/91 |
| 3,568,657 | 3/1971 | Gue | 125/40 |
| 3,700,196 | 10/1972 | Hall | 248/44 |
| 4,261,424 | 4/1981 | Gonterman et al. | 173/91 |
| 4,405,005 | 9/1983 | Zanker | 144/193 |
| 4,624,323 | 11/1986 | Burrola | 173/90 |
| 4,688,969 | 8/1987 | Bruser et al. | 405/303 |
| 5,123,584 | 6/1992 | Harrison | 227/147 |
| 5,165,663 | 11/1992 | Wells | 256/19 |
| 5,396,743 | 3/1995 | Bellette | 52/154 |
| 5,474,554 | 12/1995 | Ku | 227/147 |
| 5,671,814 | 9/1997 | Smith | 173/91 |

*Primary Examiner*—Scott A. Smith
*Attorney, Agent, or Firm*—Glenn E. Gold

[57] ABSTRACT

A portable hand tool is provided for inserting a marker flag into the ground. The tool has a shaft (12) having a handle (30) attached at a first end, and a ground penetrating tip (14) extending from a second end. The ground penetrating tip has an aperture which extends longitudinally through shaft (12) and is adapted for receiving the stem portion of a marker flag. In operation, a portion (42) of the end of the flag stem is inserted in aperture (16). The flag stem is then bent back toward the tool shaft forming a U-shaped bend (44) in the flag stem. Following insertion into the ground, the bend acts as a barb to anchor the flag stem in the ground.

2 Claims, 2 Drawing Sheets

FLAG INSERTION TOOL

FIELD OF THE INVENTION

This invention relates generally to hand tools, and more particularly to a tool for anchoring a marker flag into the ground.

BACKGROUND OF THE INVENTION

Many types of workers use flag markers for identifying the location of objects buried beneath the ground. For instance, surveyors, cable television workers, and utility company workers commonly use flag markers to locate wires, cables, and various other objects and structures in a variety of terrains. Regardless of the application, it is generally desirable to minimize the time and effort required for flag insertion, while maintaining adequate anchoring of the flag stem in the ground. Often, an insertion tool is required to implant the flags into the ground.

Historically, the use of cumbersome and heavy flag insert tools have contributed to the time and effort required to insert these markers in the ground. More recently, there has been a recognized need for a more lightweight portable marker flag insertion tool. One such tool is disclosed in U.S. Pat. No. 5,671,814 to Smith. As illustrated in FIG. 1, Smith discloses a multiple component flag insert tool including an inner rod, an outer rod, and a pair of collars. The inner rod has a V-shaped notch at one end. The collars are welded to the inner rod. The outer rod is slidably mounted between the collars. In operation, Smith's insertion tool requires the user to initially insert the flag stem through an aperture in the inner rod to form an L-shaped bend at the end of the stem. Subsequently, the flag stem is removed from the aperture and the horizontal length of the flag stem positioned on the ground beneath the V-shaped notch. Driving the flag stem into the ground requires the repeated raising and lowering of the outer rod to exert a pounding force against the lower collar.

Although Smith's insertion tool provides a number of advantages over those historically used, it leaves much room for improvement. In particular, the relatively large surface area,of the V-shaped insertion end of the tool provides an ineffective surface for penetrating the ground, resulting in the need for the repeated pounding force of the outer rod against the lower collar to drive the flag stem into the ground. In use, the tool requires a multi-step flag insertion method which adds to its inefficiency. Furthermore, the multi-component construction of the tool contributes to increased tool manufacturing time and cost.

For the foregoing reasons, a need exists for an improved portable flag insertion tool that provides a more effective and more efficient means for flag marker insertion. It would be desirable to provide such a tool having a minimal number of individual components such that the tool can be manufactured in a more time- and cost-effective manner.

SUMMARY OF THE INVENTION

It is an object of this invention to provide an improved lightweight, portable marker flag insertion tool for effectively inserting and anchoring flag markers in the ground.

It is another object of this invention to provide an improved marker flag insertion tool having an insertion end designed for facilitating penetration of the tool into the ground.

It is yet another object of this invention to provide a ground marker insertion tool which, in operation, minimizes the number of steps required to insert a marker flag into the ground.

It is a further object of this invention to provide a marker flag insertion tool having a minimal number of components that can be manufactured efficiently and cost effectively.

An improved marker flag insertion tool comprises a rod having a shaft and first and second ends. A handle attached at the first end provides a first surface for gripping the tool and a second surface for receiving a force imparted by a second tool, such as a hammer, for driving the second end of the insertion tool into the ground. A ground-penetrating tip formed at the second end of the rod has an annular surface adapted for cutting or burrowing into the ground. The annular surface has rounded notch formed therein for imparting, and subsequently supporting, a bend in the flag stem. The tip has an aperture extending longitudinally through the rod shaft along a central axis thereof.

In operation, a length of the marker flag stem is inserted through the aperture into the rod stem. The remainder of the flag stem is then bent back against the rod until the flag stem lies approximately parallel to the rod, forming an approximately U-shaped bend in the flag stem. Subsequently, the user simultaneously grips the flag stem and the tool with one hand and the ground-penetrating tip is driven into the ground to a desired depth. Where the terrain is relatively soft, the user can simply grip the tool handle and manually push the tool into the ground. Where harder terrain is encountered, a second instrument, such as a hammer, can be used to drive the rod tip into the ground by imparting a force against the handle. Upon removing the tool from the ground, the U-shaped bend in the flag stem acts to securely anchor the marker flag in the ground.

DETAILED DESCRIPTION OF PREFERRED EMBODIMENTS

Figure 1:
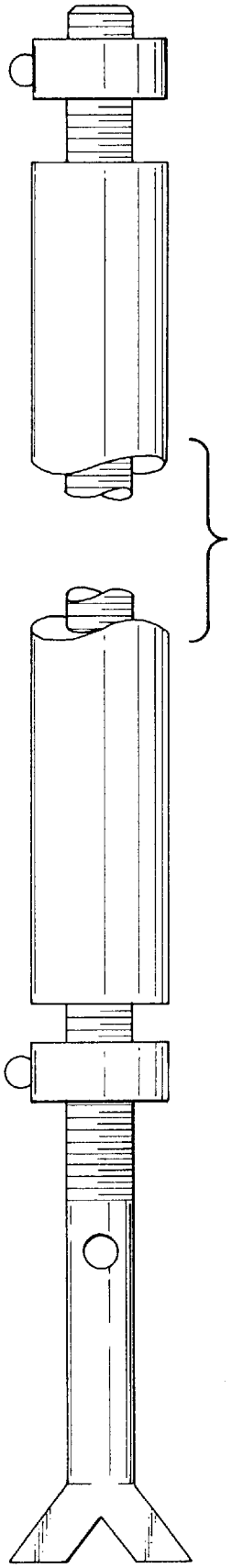
FIG. 1 (PRIOR ART)
FIG. 1 is a marker flag insertion tool in accordance with the prior art.

While the specification concludes with claims defining the features of the invention that are regarded as novel, it is believed that the invention will be better understood from a consideration of the following description in conjunction with the drawing figures.

Figure 2:
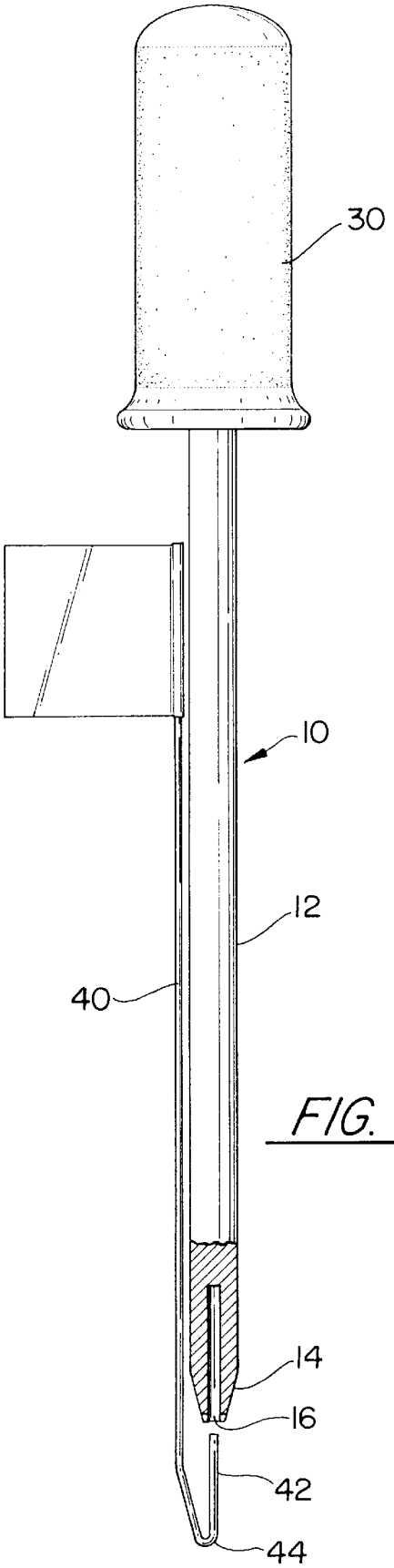
FIG. 2 is a partial cross-section view of an insertion tool in accordance with a preferred embodiment of applicant's invention.
Figure 3:
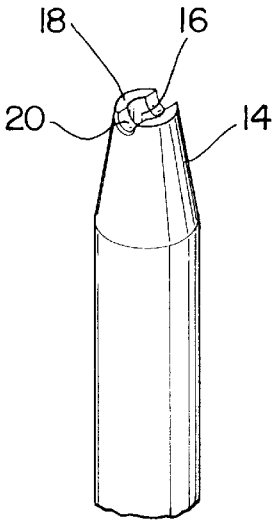
FIG. 3 is a perspective view of a flag marker insertion tool tip in accordance with a preferred embodiment of applicant's invention.

Referring to FIGS. 2–3, a portable marker flag insertion tool includes a rod 10 having a shaft 12 and an integral ground-penetrating tip 14. Preferably, the ground-penetrating tip is machined from the end of a solid metal rod. Alternatively, the rod can be manufactured from a non-metallic material. For instance, the rod could be molded from a plastic material. Regardless of the material used, the rod should be sufficiently rigid to withstand insertion into the ground with minimal bending of the shaft. A handle 30 attached at an end of the shaft opposite the ground-penetrating tip provides a surface for gripping the tool. Where hard terrain is encountered, the top of the handle can be used for imparting a driving force to the tool, for example, with a hammer.

The shaft 12 tapers radially inward to form the ground penetrating tip 14. An aperture 16 in the tip extends longitudinally in a direction away from the tip and along a central axis of shaft 12. Aperture 16 is sized for receiving a length 42 of a marker flag stem 40. In the preferred embodiment of the invention, ground-penetrating tip 14 terminates at an annular surface 18 which surrounds aperture 16. At least one U-shaped notch 20 is formed in surface 18 for creating, and subsequently supporting, a bend 44 in flag stem 40. In contrast to known portable insertion tools, the present invention is provided with a notch having a smooth surface profile designed to minimize the potential for flag stem shearing during subsequent insertion of the marker flag into the ground.

Figure 4:
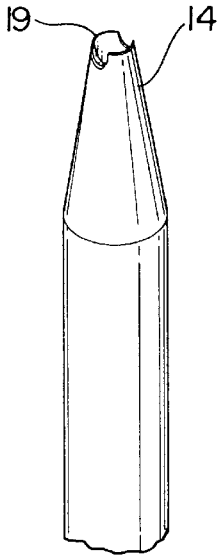
FIG. 4 is a perspective view of a flag marker insertion tool tip in accordance with an alternate embodiment of applicant's invention.

Referring now to FIG. 4, in an alternate embodiment of the present invention ground-penetrating tip 14 terminates at an edge 19. The edge may be sharpened to provide improved penetration of tip 14 into the ground, especially for marker flag insertion into hard or rocky terrain.

In operation, a first length 42 of flag stem 40 is inserted into aperture 16. Flag stem 40 is bent over notch 20 until the remaining length of the flag stem is positioned adjacent to, and substantially parallel to, rod 10 to form a substantially U-shaped bend 44 in the end of the flag stem. In some cases, marker flags may be provided with pre-bent flag stems. For instance, plastic molded flag stems would necessarily have to be provided with a preformed bend. Where a preformed bend is provided, the bent length of the flag stem is simply inserted into the aperture 16, leaving the remainder of the flag stem positioned adjacent the tool shaft 12. The flag stem and tool shaft can be simultaneously gripped with one hand and driven into the ground by hand where soft terrain is encountered. When harder terrain is encountered, a second instrument, such as a hammer, can be used to impart a force upon handle 30 to drive the penetrating tip 14 into the ground. Upon reaching the desired depth of penetration, the tool is removed from the ground leaving the marker flag behind. The U-shaped bend 44 in marker stem 40 acts as a barb for anchoring the flag stem in the ground.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims. For instance, the illustration of the shaft 12 having a cylindrical shape, or the ground-penetrating tip 14 having a smooth outer surface is not intended to be so limiting. For example, it will occur to one having ordinary skill in the art that the shaft and tip could have non-smooth outer surfaces comprising multiple planar sides. Furthermore, portions of the tip surface 18 or edge 19 could extend outwardly to form a leading edge portion of the tip to further protect the flag stem from severing during insertion.

What is claimed is:

1. A method for anchoring a workpiece into a ground surface using a portable tool, the tool including a rod shaft having a ground penetrating tip, the tip having an integral notch and an aperture extending longitudinally away from the tip along a central axis of the rod shaft, the method comprising the steps of:

inserting a first end of said workpiece wire into said ground-penetrating tip aperture;

bending said workpiece such that an outer surface of said workpiece engages said notch and is frictionally maintained against said notch;

driving said ground-penetrating tip into said ground surface such that a length of said workpiece proximate said first end is deformed into a hook shape; and withdrawing said rod shaft from said ground surface, whereby, upon withdrawing said rod shaft from said ground surface the hook-shaped end of said workpiece wire is maintained below said ground surface for anchoring the workpiece into the ground.

2. A method as recited in claim 1, wherein said workpiece comprises a stem portion of a marker flag assembly.

* * * * *